US010260821B2

(12) United States Patent
Maegawa et al.

(10) Patent No.: US 10,260,821 B2
(45) Date of Patent: Apr. 16, 2019

(54) FLAT TUBE FOR HEADER-PLATELESS HEAT EXCHANGER

(71) Applicant: T.RAD Co., Ltd., Tokyo (JP)

(72) Inventors: Kazuo Maegawa, Tokyo (JP); Hirohito Sugimoto, Tokyo (JP); Masahito Sekiya, Tokyo (JP)

(73) Assignee: T.RAD Co., Ltd., Tokyo (JP)

( * ) Notice: Subject to any disclaimer, the term of this patent is extended or adjusted under 35 U.S.C. 154(b) by 35 days.

(21) Appl. No.: 15/329,907

(22) PCT Filed: Jul. 24, 2015

(86) PCT No.: PCT/JP2015/071731
§ 371 (c)(1),
(2) Date: Jan. 27, 2017

(87) PCT Pub. No.: WO2016/017788
PCT Pub. Date: Feb. 4, 2016

(65) Prior Publication Data
US 2017/0268831 A1 Sep. 21, 2017

(30) Foreign Application Priority Data
Jul. 30, 2014 (JP) ..... 2014-155325

(51) Int. Cl.
*F28F 3/08* (2006.01)
*B21D 53/04* (2006.01)
(Continued)

(52) U.S. Cl.
CPC ..... *F28F 3/08* (2013.01); *B21D 53/04* (2013.01); *F28F 1/025* (2013.01); *F28F 1/04* (2013.01);
(Continued)

(58) Field of Classification Search
CPC ..... F28D 9/00; F28D 9/0031; F28D 1/0308; F28D 7/1684; F28D 21/003; F28F 1/00;
(Continued)

(56) References Cited

U.S. PATENT DOCUMENTS 2,339,284 A * 1/1944 Modine ..... B21D 53/04 165/148
4,681,155 A * 7/1987 Kredo ..... F28F 3/025 138/163
(Continued)

FOREIGN PATENT DOCUMENTS

CN 103201582 A 7/2013
EP 0874210 A2 7/2007
(Continued)

OTHER PUBLICATIONS

JP 2013 96632 Machine Translation.*

*Primary Examiner* — Len Tran
*Assistant Examiner* — Gustavo A Hincapie Serna
(74) *Attorney, Agent, or Firm* — Norris McLaughlin, P.A.

(57) ABSTRACT

A flat tube for a header-plateless heat exchanger has an inner plate and an outer plate that are each press-molded from a metal plate and are curved/folded into a groove shape comprising a groove bottom section and two side wall sections. Both plates are such that the outer plate is fitted to the outside of the inner plate in a manner such that the groove bottom sections oppose each other, and an expanded opening in the thickness direction is formed at both ends of the plates.

2 Claims, 6 Drawing Sheets

(51) Int. Cl.

| | |
|---|---|
| ***F28F 3/10*** | (2006.01) |
| ***F28F 1/02*** | (2006.01) |
| ***F28F 1/04*** | (2006.01) |
| *F28D 9/00* | (2006.01) |
| *F28F 1/00* | (2006.01) |
| *F28F 3/12* | (2006.01) |
| *F28D 1/03* | (2006.01) |
| *F28D 7/16* | (2006.01) |
| *F28D 21/00* | (2006.01) |

(52) U.S. Cl.
CPC ..... *F28F 3/10* (2013.01); *F28D 1/0308* (2013.01); *F28D 7/1684* (2013.01); *F28D 9/00* (2013.01); *F28D 9/0031* (2013.01); *F28D 21/0003* (2013.01); *F28F 1/00* (2013.01); *F28F 1/006* (2013.01); *F28F 1/02* (2013.01); *F28F 3/12* (2013.01); *F28F 2001/027* (2013.01)

(58) Field of Classification Search
CPC .... F28F 1/006; F28F 1/02; F28F 1/025; F28F 2001/027; F28F 3/08; F28F 3/10; F28F 3/12; F28F 1/04; B21D 53/04
USPC ..... 165/168, 169, 170, 177
See application file for complete search history.

(56) References Cited

U.S. PATENT DOCUMENTS

| | | | | |
|---|---|---|---|---|
| 6,513,585 | B2 * | 2/2003 | Brost | B21D 53/085 165/173 |
| 6,668,916 | B2 * | 12/2003 | Zobel | F28F 9/0221 165/173 |
| 8,235,098 | B2 * | 8/2012 | Agee | F28F 1/02 165/148 |
| 9,222,731 | B2 * | 12/2015 | Dinulescu | B21D 51/52 |
| 2002/0108742 | A1 * | 8/2002 | Lamich | F28F 9/0221 165/175 |
| 2010/0319889 | A1 * | 12/2010 | Ikeda | F02B 29/0462 165/157 |

FOREIGN PATENT DOCUMENTS

| | | | | |
|---|---|---|---|---|
| GB | 2384299 | A | 7/2003 | |
| JP | 2004-028469 | A | 1/2004 | |
| JP | 2004-293988 | A | 10/2004 | |
| JP | 2011-038752 | A | 2/2011 | |
| JP | 2011 43257 | * | 3/2011 | |
| JP | 2011-163642 | A | 8/2011 | |
| JP | 2012-247093 | A | 12/2012 | |
| JP | 2013 96632 | * | 2/2013 | F28F 3/10 |
| JP | 2013-096632 | A | 5/2013 | |
| WO | 02/100567 | A1 | 12/2002 | |

* cited by examiner

FLAT TUBE FOR HEADER-PLATELESS HEAT EXCHANGER

BACKGROUND OF THE INVENTION

The present invention relates to a flat tube for a header-plateless heat exchanger which is employed for an EGR cooler and the like.

Japanese Patent Laid-Open No. 2013-096632 discloses a flat tube used for a header-plateless heat exchanger. The flat tube is configured such that a pair of groove-like plates are fitted opposite to each other and the openings at both ends are expanded in the thickness direction to form an expanded opening.

Linear side wall parts each with U-like cross section perpendicular to the bottom surface are formed on both side walls of the expanded openings of the both plates. Curved wall parts in which the cross sections of both side walls of each plate curve outward are formed at the sections except the expanded openings.

The side wall part of the expanded opening of the inner plate has, at the midpoint in the height direction, a stepped wall part formed with an inward step portion corresponding to the plate thickness. A pair of guide surfaces each curved and folded inward are formed at the leading edges of each stepped wall part. Each leading end of the guide surfaces is formed so as to abut on the base of the side wall part of the outer plate. The guide surface allows easy assembly of the flat tube.

SUMMARY OF INVENTION

However, the material for forming the flat tube as disclosed in Japanese Patent Laid-Open No. 2013-096632 has to be cut in manufacturing the respective plates, resulting in waste.

Accordingly, it is an object of the present invention to provide a flat tube for header-plateless heat exchanger, which is configured to minimize the material to be cut during processing of the respective plates which constitute the flat tube for utilizing the material to the maximum limit while preventing the waste.

The present, with reference to the drawings, provides a flat tube for header-plateless heat exchanger, the flat tube including an inner plate (2) and an outer plate (3) each formed by press molding a metal plate, curved and folded into a groove shape, and each including a groove bottom section (7) and two side wall sections (8), the both plates (2), (3) being configured such that the outer plate (3) is fitted to an outer side of the inner plate (2) with the groove bottom sections (7) facing each other, and expanded openings (9) are formed at both ends of the respective plates (2), (3) in a thickness direction, the "expanded openings" (9) being end portions of the plates which, when assembled to form the flat tube, provide the flat tube with portions of expanded dimension in a thickness direction of the flat tube wherein: both end sections (4) of the two side wall sections (8) of the inner plate (2) have a pair of stepped wall parts (10) each curved and folded inward in a hook shape by an amount corresponding to a plate thickness and each having a linear lateral cross section, and a pair of inner curved wall parts (11) each having a lateral cross section curved outward are formed at an intermediate section (5) of the inner plate (2) includes; both end sections (4) of the two side wall sections (8) of the outer plate (3) have a pair of outer fitting wall parts (13) matching the stepped wall parts (10) and each having a linear lateral cross section, and an outer curved wall part (12) having the lateral cross section curved to the outer side and matching the inner curved wall part (11) is formed at an intermediate section (5) of the outer plate (3); a height of the stepped wall part (10) of the inner plate (2) from the groove bottom section (7) is formed to be lower than a height of the part except the stepped wall part (10) from the groove bottom section (7); an edge (13*a*) of the outer fitting wall part (13) of the outer plate (3) is seated on a step portion (10*a*) of the stepped wall part (10) of the inner plate (2); and an inner surface of the outer curved wall part (12) of the outer plate (3) is brought into pressure contact with an outer surface of the inner curved wall part (11) of the inner plate (2).

Preferably, an inner peripheral length (2×L1+L2) of the lateral cross section of the expanded opening (9) of the inner plate (2) is formed to be equal to an inner peripheral length of the lateral cross section of the part except the expanded opening (9).

Preferably, an inner peripheral length (2×L5+L6) of the lateral cross section of the expanded opening (9) of the outer plate (3) is formed to be equal to an inner peripheral length (2×L7+L8) of a lateral cross section of the intermediate section (5) of the outer plate (3).

According to the invention, the height of the stepped wall part 10 of the inner plate 2 from the groove bottom section 7 is formed to be lower than the height of the part except the stepped wall part 10 from the groove bottom section 7. It is therefore possible to mold the inner plate 2 from the metal plate with uniform width along the whole length for forming the groove-like inner plate 2 with the stepped wall part 10 by press molding the metal plate. In other words, it is possible to accommodate reduction in the height of the side wall at the expanded opening 9 in molding thereof, as it is. This makes it possible to utilize the metal plate without waste for manufacturing the flat tube with favorable yield.

Further, as respective lateral cross sections of a step portion 10*a* of the stepped wall part 10 of the inner plate 2, and an edge 13*a* of an outer fitting wall part 13 of the outer plate 3 are linearly formed, the inner plate 2 and the outer plate 3 may be accurately positioned upon seating of the edge 13*a* onto the step portion 10*a*.

Simultaneously, curved wall parts 11, 12 of the both plates 2, 3 are brought into pressure contact so that both plates 2, 3 may be self-supported, and thus it is possible to provide the easily assembled header-plateless heat exchanger.

Moreover, in the case that the length of the inner periphery of the lateral cross section of the expanded opening 9 of the inner plate 2 is formed to be equal to that of the inner periphery of the lateral cross section of the part except the expanded opening 9, when the groove-like inner plate 2 with the expanded opening 9 and the stepped wall part 10 is formed by press molding the metal plate, it is possible to mold the inner plate 2 from the metal plate with uniform width along the whole length. This makes it possible to utilize the metal plate to the maximum limit with no waste, and to easily manufacture the flat tube with favorable yield.

Furthermore, in the case that the length of the inner periphery of the lateral cross section of the expanded opening 9 of the outer plate 3 is formed to be equal to that of the inner periphery of the lateral cross section of an intermediate section 5 of the outer plate 3, when the groove-like outer plate 3 with the expanded opening 9 is formed by press molding the metal plate with uniform width along substantially the whole length, it is possible to mold the outer plate 3 from the metal plate with uniform width along substantially the whole length, and to minimize the cutting of the metal plate. Therefore, it is possible to further utilize the metal plate to the maximum limit with no waste, and to easily manufacture the flat tube with favorable yield.

BRIEF DESCRIPTION OF DRAWINGS

FIGS. 7(A) and 7(B) show an essential portion of the flat tube, wherein FIG. 7(A) is an exploded perspective view, and FIG. 7(B) is a perspective view in the assembled state.

DETAILED DESCRIPTION OF THE INVENTION

Figure 1:
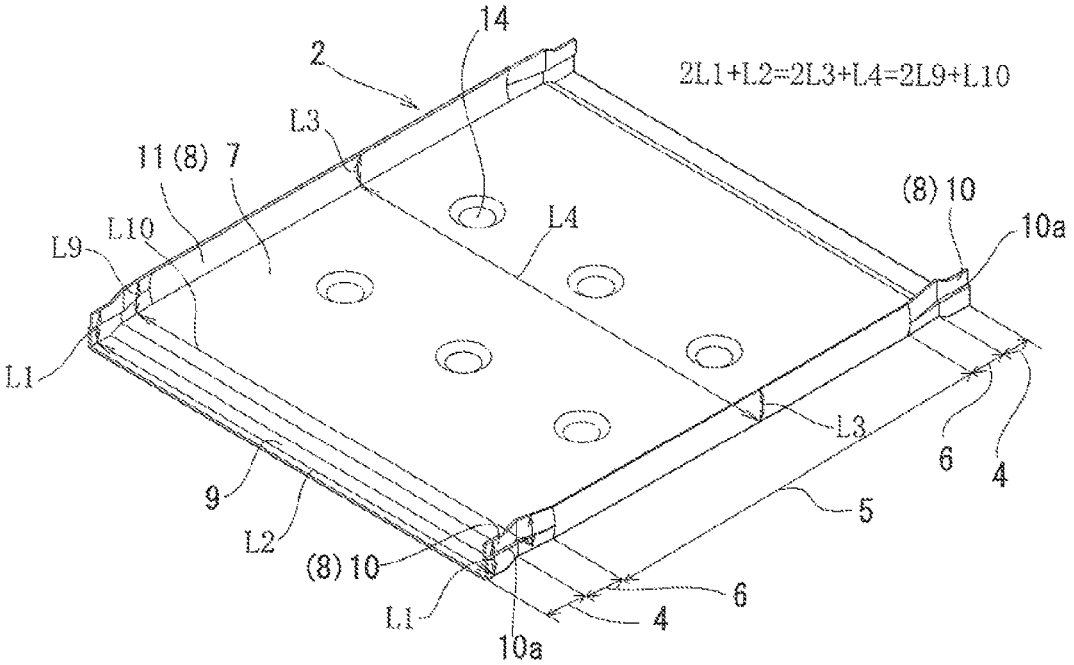
FIG. 1 is a perspective view of an inner plate 2 used in a flat tube for header-plateless heat exchanger of the present invention.

Next, an embodiment of the present invention will be described based on the drawings.

A flat tube 1 for header-plateless heat exchanger of the present invention includes a pair of inner plate 2 and outer plate 3.

Each of the plates 2, 3 is formed by press molding the metal plate respectively, which is curved and folded into a flat groove shape constituted by a groove bottom section 7 and two side wall sections 8, to form expanded openings 9 expanding in the thickness direction at the both ends.

Figure 5:
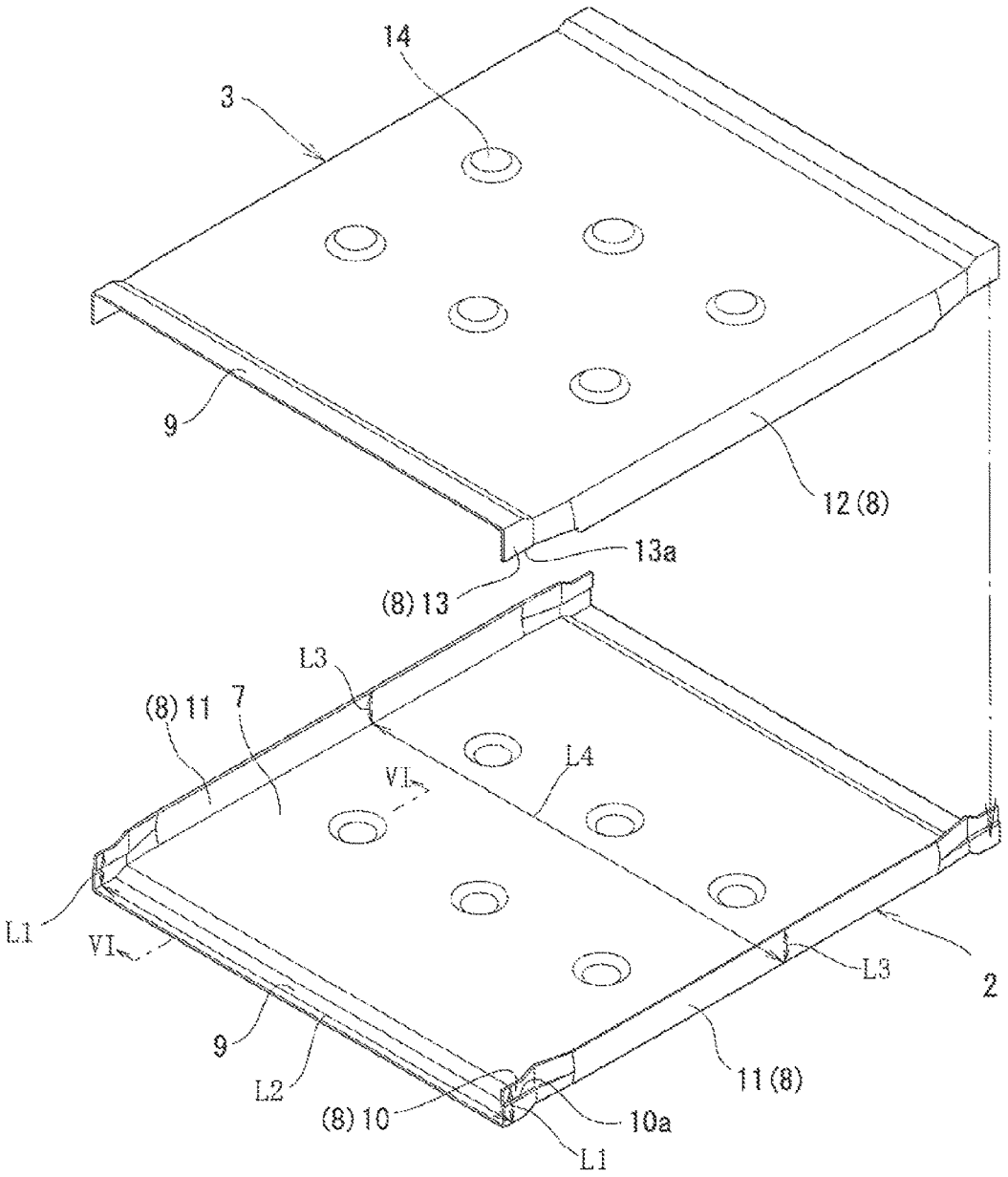
FIG. 5 is an exploded perspective view of the flat tube for header-plateless heat exchanger of the present invention.

Those plates 2, 3 constitute the flat tube 1 by fitting the inner surface of the side wall section 8 of the outer plate 3 with the corresponding outer surface of the side wall section 8 of the inner plate 2 with the respective groove bottom sections 7 facing each other as shown in FIG. 5.

(Feature of Inner Plate 2)

As FIG. 1 shows, the inner plate 2 includes end sections 4, an intermediate section 5, and gradual changing sections 6.

Stepped wall parts 10 each with a pair of step portions 10*a* curved and folded inside in a hook shape by the degree corresponding to the plate thickness while having a linear lateral cross section are formed at the both end sections 4 of each of the side wall sections 8 of the inner plate 2. Further, a pair of inner curved wall parts 11 each having the lateral cross section curved outward are formed at the intermediate section 5 of the inner plate 2.

As the expanded opening 9 of the inner plate 2 is formed from the metal plate with uniform width, the groove bottom section 7 of the stepped wall part 10 is formed at the position lower than that of the groove bottom section 7 of the part except the stepped wall part 10.

Each of the gradual changing sections 6 is formed between the end section 4 and the intermediate section 5 of the plates 2, 3, respectively. However, the gradual changing section 6 is a transitional part of the side wall section 8, which is gradually curved from the linear end section 4 toward the intermediate section 5.

As FIG. 1 shows, the step portion 10*a* formed in the end section 4 of the inner plate 2 extends to the gradual changing section 6 at the same height. However, the width of the step portion 10*a* is reduced gradually toward the intermediate section 5 until the step portion no longer exists at the end.

Herein, the inner periphery of the lateral cross section of the expanded opening 9 (end section 4) will be described.

Firstly, the inner peripheral length of the stepped wall part 10 is set to L1, and the length of the groove bottom section 7 is set to L2.

Further, as for the inner periphery of the lateral cross section of the intermediate section 5, the length of the inner curved wall part 11 is set to L3, and the length of the groove bottom section 7 is set to L4. Furthermore, as for the inner periphery of the lateral cross section of the gradual changing section 6, the length of the side wall section 8 is set to L9, and the length of the groove bottom section is set to L10.

In the present invention, each of the inner peripheral length of the lateral cross section of the expanded opening 9 of the inner plate 2, that is, (2×L1+L2), the inner peripheral length of the lateral cross section of the intermediate section 5, that is, (2×L3+L4), and the inner peripheral length of the lateral cross section of the gradual changing section 6, that is, (2×L9+L10) is designed to be set to the same value.

Figure 3:
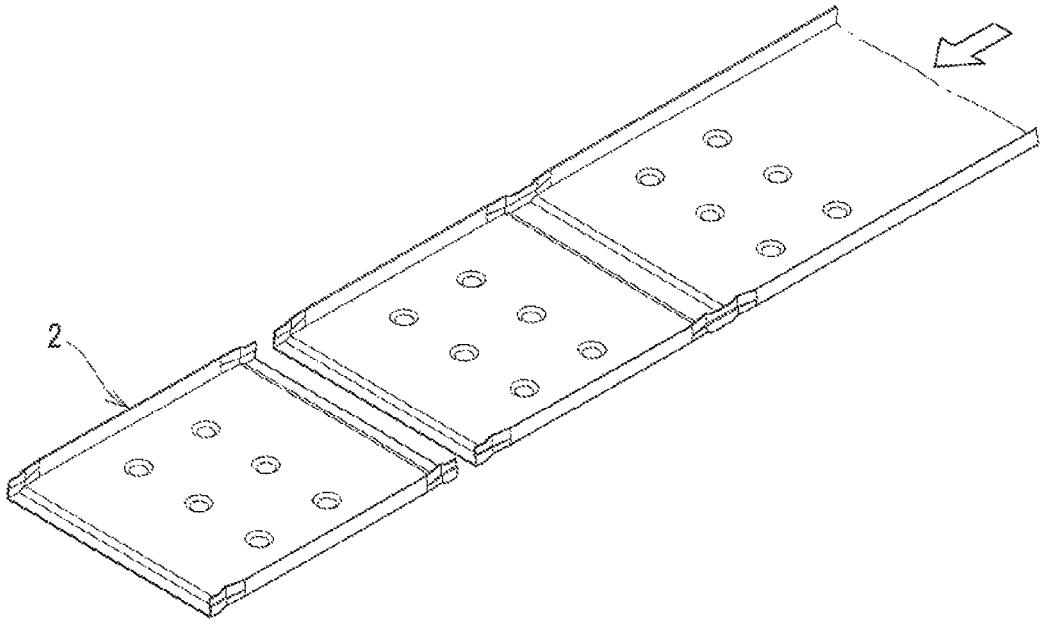
FIG. 3 is an explanatory view illustrating the manufacturing process of the inner plate 2.

In this case, as shown in FIG. 3, it is possible to mold the inner plate 2 from the metal plate with uniform width along the whole length. Further, the metal plate will be cut only when the inner plate 2 is separated.

(Feature of Outer Plate 3)

Figure 2:
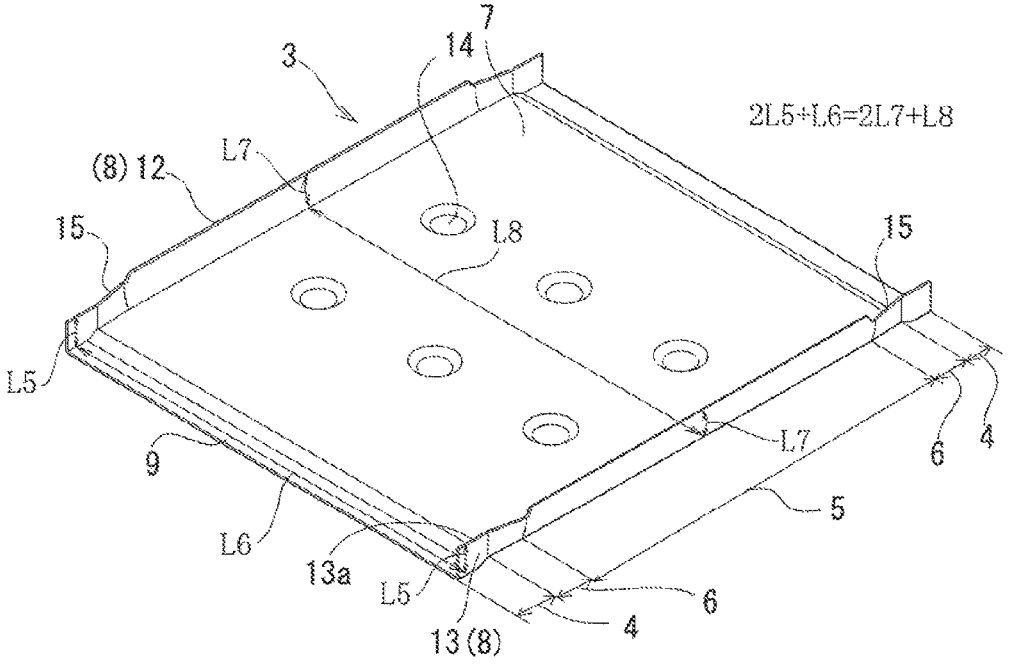
FIG. 2 is a perspective view of an outer plate 3 of the flat tube.

As FIG. 2 shows, likewise the inner plate 2, the outer plate 3 includes the end sections 4, the intermediate section 5, and the gradual changing sections 6. Each length of the respective sections matches the outer peripheral of the inner plate 2.

The pair of outer fitting wall parts 13 having the linear lateral cross section, matching the outer peripheries of the stepped wall parts 10 of the inner plate 2 are formed on both end sections 4 of the respective side wall sections 8 of the outer plate 3. Moreover, the pair of outer curved wall parts 12 each matching the outer periphery of the inner curved wall part 11 of the inner plate 2, having the lateral cross section curved outward are formed along the intermediate section 5 of the outer plate 3.

Since the outer plate 3 forms the expanded opening 9 from the plate with uniform thickness, the height of the expanded opening 9 from the groove bottom section 7 at the outer fitting wall part 13 is formed lower than that of the part except the outer fitting wall part 13 from the groove bottom section 7.

Here, the inner periphery of the lateral cross section of the expanded opening 9 (end section 4) will be described.

Firstly, the length of the outer fitting wall part 13 is set to L5, and the length of the groove bottom section 7 is set to L6. Further, as for the inner periphery of the lateral cross section of the intermediate section 5, the length of the outer curved wall part 12 is set to L7, and the length of the groove bottom section 7 is set to L8.

In the present invention, each of the inner peripheral length of the lateral cross section of the expanded opening 9 (end section 4) of the outer plate 3, that is, (2×L5+L6), and the inner peripheral length of the lateral cross section of the intermediate section 5, that is, (2×L7+L8) is set to the same value.

In order to adapt to the height from the groove bottom section 7 to the edge 13*a* of the outer fitting wall part 13, the gradual changing section 6 of the outer plate 3 has a notch 15 cut for consistency with the height. As a result, the inner peripheral length of the lateral cross section of the gradual changing section 6 of the outer plate 3 becomes shorter than each length of the other sections (end section 4, intermediate section 5).

Figure 4:
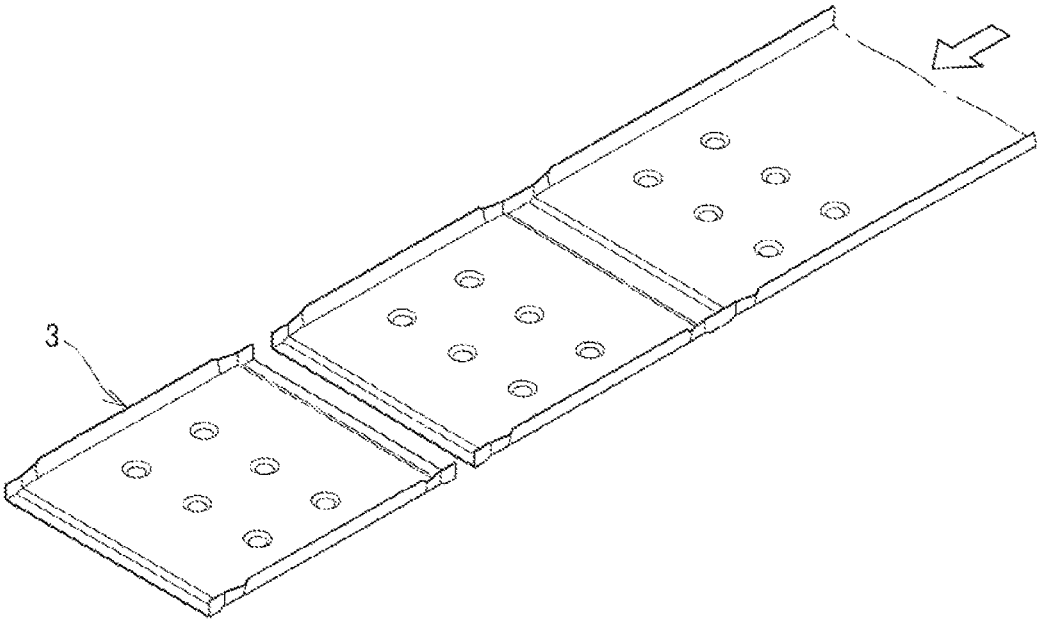
FIG. 4 is an explanatory view illustrating the manufacturing process of the outer plate 3.

In the above-described case, as shown in FIG. 4, it is possible to mold the outer plate 3 from the metal plate with uniform width along substantially the whole length except the part corresponding to the gradual changing section 6, and to suppress the cutting of the metal plate to a minimum.

(Assembly of Flat Tube 1)

Figure 6:
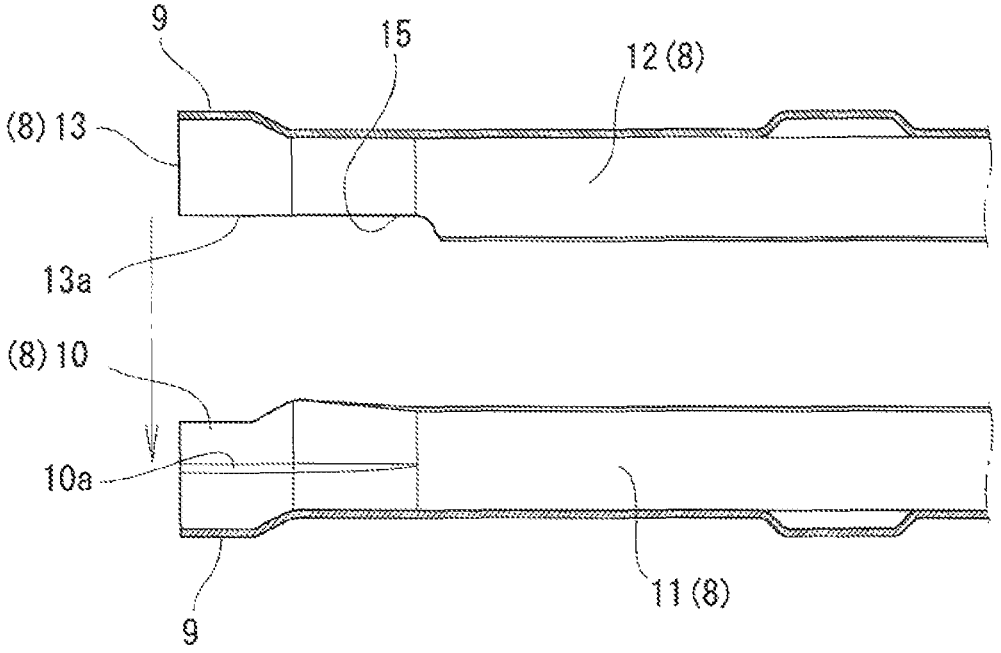
FIG. 6 is a VI-VI arrow sectional view of FIG. 5.

As shown in FIG. 5 and FIG. 6, the thus formed inner plate 2 and the outer plate 3 are configured to allow the edge 13*a* of the outer fitting wall part 13 of the outer plate 3 to be seated on the step portion 10*a* of the stepped wall part 10 of the inner plate 2, and the edge of the notch 15 to be seated on the step portion of the gradual changing section 6 of the inner plate 2.

Figure 8:
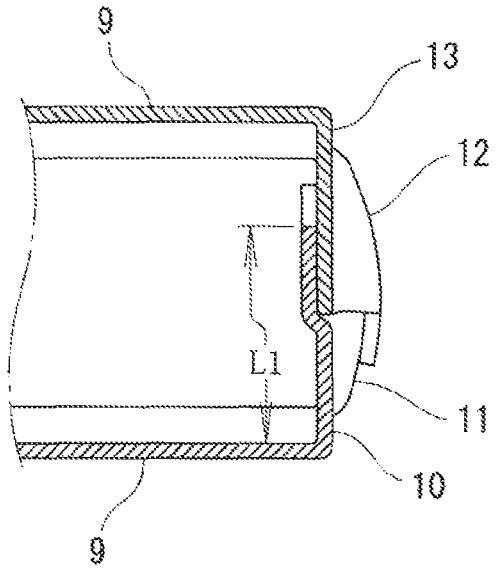
FIG. 8 is a VIII-VIII arrow sectional view of FIG. 7(B).

At this time, the outer surface from the step portion 10*a* to the leading end of the stepped wall part 10 of the inner plate 2 is fitted with the inner surface of the outer fitting wall part 13 as shown in FIG. 8.

Figure 7A:
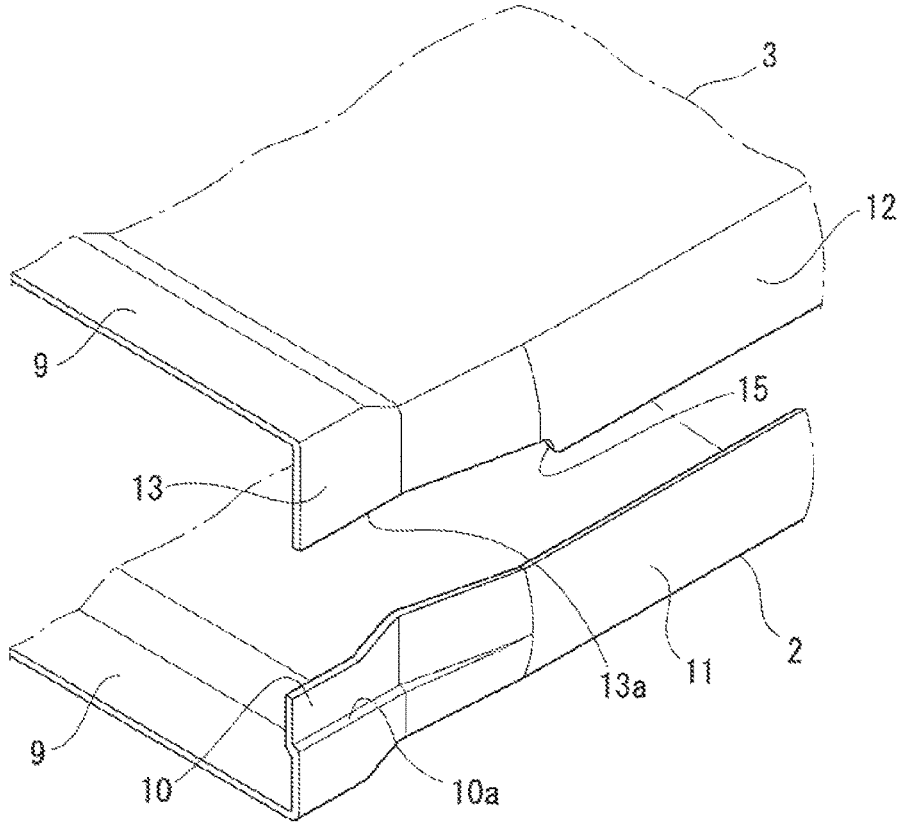
Figure 7B:
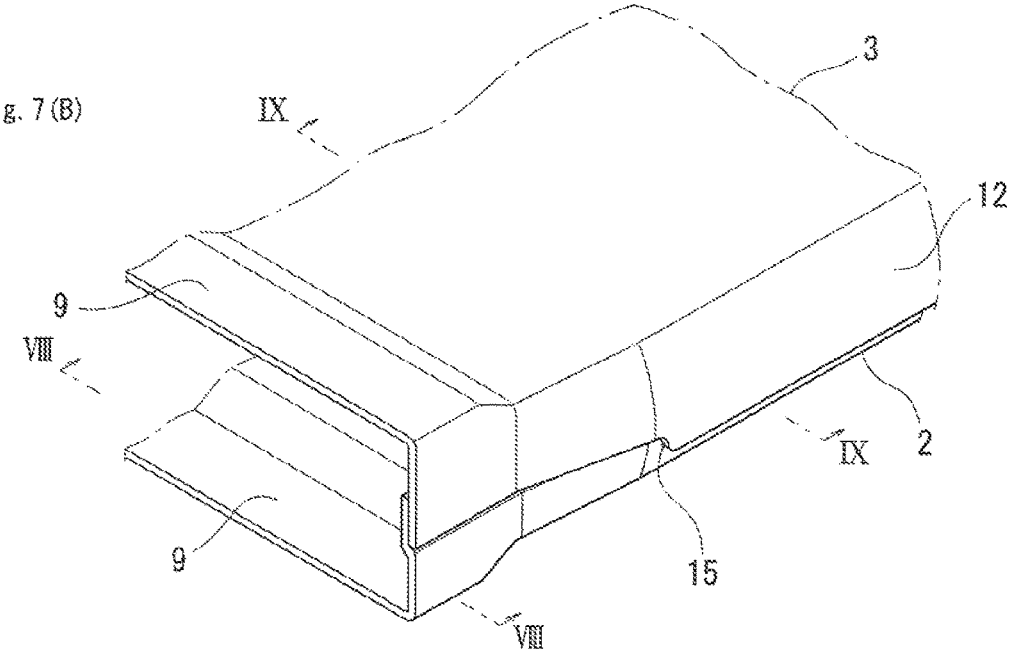

Further, the outer surface of the inner plate 2 from the step portion 10*a* of the stepped wall part 10 to the groove bottom section 7 is formed to flush with the outer surface of the outer fitting wall part 13 of the outer plate 3. In the case that both plates 2, 3 are fitted, the outer periphery at both ends of the flat tube 1 is formed into substantially a quadrate shape except the joint part formed on the step portion 10*a* as shown in FIG. 7(B) and FIG. 8.

Furthermore, the inner surface of the outer curved wall part 12 of the outer plate 3 is brought into pressure contact with the outer surface of the inner curved wall part 11 of the inner plate 2 to complete assembly of the flat tube 1.

Figure 9:
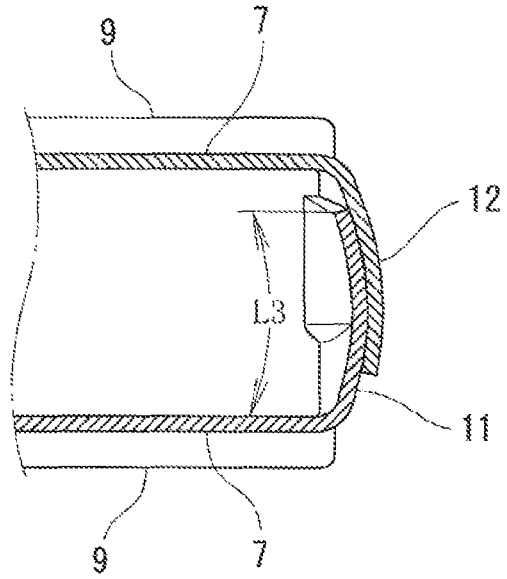
FIG. 9 is a IX-IX arrow sectional view of FIG. 7(B).

Note that, as FIG. 9 shows, once the inner plate 2 and the outer plate 3 are fitted, the curved wall parts 11, 12 of both plates 2, 3 serve to elastically join the plates under pressure so as not to be separated.

A not shown inner fin is disposed inside the flat tube 1 described above. The inner fin with known structure may be employed.

A plurality of dimples 14 protrudes toward the outer surface of each of the plates 2, 3 in alignment with one another. The protruding height of the dimple 14 is the same as that of the expanded opening 9.

A brazing material is applied or coated onto at least one surface of each of the plates 2, 3, and not shown inner fin, which will be brought into contact with one another.

Further, the plurality of flat tubes 1 is laminated at the expanded openings 9 at both ends so as to form the core of the heat exchanger. The casing and the header tank are fitted with the outer periphery of the core, which will be integrally brazed and fixed in the furnace at high temperature while having the respective components in the pressurized state.

At this time, the inner fins are disposed inside the respective flat tubes 1, and the dimples 14 on the outer surfaces of the respective flat tubes 1 are brought into contact. The height of the dimples in the contact state may be specified at the intermediate section of the flat tube 1.

Next, as an example, the casing is formed into a cylindrical shape while fitting a pair of groove-like materials. The lateral cross section of the casing has a quadrate shape. A pair of inlet/outlet of cooling water are formed in the side wall of the casing, to which a cooling water pipe is connected.

Furthermore, as an example, exhaust gas circulates through the respective flat tubes 1 of the core. The cooling water circulates in the flat tube 1 at the outer surface side, so that the cooling water serves to cool the exhaust gas.

The invention claimed is:

1. A flat tube for a header-plateless heat exchanger comprising an inner plate and an outer plate each formed by press molding a metal plate, curved and folded into a groove shape, and each inner and outer plate including a groove bottom section and two side wall sections, the inner and outer plates being configured such that the outer plate is fitted to an outer side of the inner plate with the groove bottom sections facing each other, and expanded openings are formed at ends of the respective inner and outer plates in a thickness direction, wherein:

the two side wall sections of the inner plate each comprise a pair of adjacent stepped wall parts each curved and folded inward in a hook shape by an amount corresponding to a plate thickness and wherein each of the stepped wall parts has a linear lateral cross section, and wherein a pair of inner curved wall parts each having a lateral cross section curved outward are formed at an intermediate section of the inner plate;

the two side wall sections of the outer plate each comprise an end section having an outer fitting wall part matching corresponding of the stepped wall parts and each of the outer fitting wall parts having a linear lateral cross section, and an outer curved wall part having a lateral cross section curved to the outer side and matching the inner curved wall part is formed at an intermediate section of the outer plate;

a height of the pairs of stepped wall parts from a bottom plane defined by an end portion of the groove bottom section of the inner plate is less than a height of the side wall section of the inner plate is less than a height of the side wall section of the inner plate from the bottom plane, in a part of the side wall section of the inner plate other than the pairs of stepped wall parts;

an edge of the outer fitting wall part of the outer plate is seated on a step portion of one of the stepped wall parts of the inner plate;

an inner surface of the outer curved wall part of the outer plate is in pressure contact with an outer surface of the inner curved wall part of the inner plate; and an inner peripheral length (2×L1+L2) of a lateral cross section of the expanded opening of the inner plate is formed to be equal to an inner peripheral length (2×L3+L4) of the lateral cross section of the intermediate section of the inner plate, wherein L2 is a distance between opposing pairs of the stepped wall parts, L1 is the height of the pairs of stepped wall parts, L4 is a distance between opposing intermediate sections of the inner plate, and L3 is a height of the intermediate sections of the inner plate from the groove bottom section of the inner plate.

2. The flat tube for the header-plateless heat exchanger according to claim 1, wherein an inner peripheral length (2×L5+L6) of a lateral cross section of the expanded opening of the outer plate is formed to be equal to an inner peripheral length (2×L7+L8) of a lateral cross section of the intermediate section of the outer plate, wherein L6 is a distance between opposing fitting wall parts, L5 is a height of the fitting wall parts,L8 is a distance between opposing intermediate sections of the outer plate, and L7 is a height of the intermediate sections of the outer plate.

* * * * *